US009622554B2

(12) United States Patent
Green

(10) Patent No.: US 9,622,554 B2
(45) Date of Patent: Apr. 18, 2017

(54) EQUIPMENT FOR USE WHEN SITTING AND WHEN WALKING, SKIING OR THE LIKE

(71) Applicant: Derrick Norman Green, Poole (GB)

(72) Inventor: Derrick Norman Green, Poole (GB)

( * ) Notice: Subject to any disclaimer, the term of this patent is extended or adjusted under 35 U.S.C. 154(b) by 0 days.

(21) Appl. No.: 14/900,672

(22) PCT Filed: May 22, 2013

(86) PCT No.: PCT/GB2013/000229

§ 371 (c)(1),
(2) Date: Dec. 22, 2015

(87) PCT Pub. No.: WO2014/188144

PCT Pub. Date: Nov. 27, 2014

(65) Prior Publication Data

US 2016/0135554 A1 May 19, 2016

(51) Int. Cl.

| | |
|---|---|
| ***A45B 5/00*** | (2006.01) |
| ***A63C 11/00*** | (2006.01) |
| ***A47C 13/00*** | (2006.01) |
| ***A45B 9/00*** | (2006.01) |

(52) U.S. Cl.

CPC ..... *A45B 5/00* (2013.01); *A45B 9/00* (2013.01); *A47C 13/00* (2013.01); *A63C 11/00* (2013.01); *A45B 2009/007* (2013.01)

(58) Field of Classification Search

CPC .... A45B 3/00; A45B 9/02; A45B 5/00; A45B 2009/002; A45B 1/00; A61H 2201/1633; A61H 2201/1635; A47C 4/28; A47C 4/00; A47C 13/00

USPC .... 135/65–66, 72, 74–76; 297/16.1, 17, 118

See application file for complete search history.

(56) References Cited

U.S. PATENT DOCUMENTS

| | | | | | |
|---|---|---|---|---|---|
| 280,843 | A * | 7/1883 | McGaughey | ..... | A45B 5/00 248/155.1 |
| 432,759 | A * | 7/1890 | Minniss | ..... | A45B 3/00 135/66 |
| 1,089,295 | A * | 3/1914 | Vallier | ..... | A45B 5/00 135/66 |

(Continued)

FOREIGN PATENT DOCUMENTS

| | | | | | |
|---|---|---|---|---|---|
| DE | 86186 | | 7/1895 | | |
| GB | 191321326 | A * | 0/1914 | ..... | A45B 5/00 |

(Continued)

OTHER PUBLICATIONS

International Search Report (ISR) issued Oct. 29, 2013 in International (PCT) Application No. PCT/GB2013/000229.

*Primary Examiner* — Winnie Yip
(74) *Attorney, Agent, or Firm* — Wenderoth, Lind & Ponack, L.L.P.

(57) ABSTRACT

A seat using a pair of walking sticks. A seat member is formed adjacent the top end of the walking sticks. The walking sticks are releasably attached to one another adjacent top ends of the walking sticks so that seat members together form a seat, and the walking sticks diverge from the seat to form a two-legged stool. Each seat member is pivotally mounted to the top end of the respective walking stick for movement between a deployed position in which the seat extends at an acute angle from the top end of the walking stick, and a stowed position in which the seat extends alongside the respective walking stick.

6 Claims, 2 Drawing Sheets

(56) References Cited

U.S. PATENT DOCUMENTS

| | | | | | |
|---|---|---|---|---|---|
| 1,166,386 | A * | 12/1915 | Perrin | A47C 9/105 | 248/155.2 |
| 1,697,552 | A * | 1/1929 | Brooks | A45B 5/00 | 135/66 |
| 2,192,475 | A * | 3/1940 | Lauckner | A45B 5/00 | 248/155 |
| D291,791 | S * | 9/1987 | Bean | D12/130 | |
| 4,786,082 | A * | 11/1988 | Swietlik | A45B 5/00 | 135/66 |
| 7,316,449 | B2 * | 1/2008 | Lynch | A61H 3/02 | 248/155.1 |
| 7,347,215 | B1 * | 3/2008 | Birnbaum | A61H 3/0277 | 135/66 |
| 2015/0313330 | A1 * | 11/2015 | Stevens | A45B 5/00 | 297/440.1 |

FOREIGN PATENT DOCUMENTS

| | | | | |
|---|---|---|---|---|
| GB | 248940 | A * | 3/1926 | A45B 5/00 |
| GB | 251 113 | | 4/1926 | |
| GB | 361609 | A * | 11/1931 | A45B 5/00 |
| JP | 2009056209 | A * | 3/2009 | A45B 5/00 |
| JP | 2010274085 | A * | 12/2010 | A45B 5/00 |

* cited by examiner 10
12
14
16
18
18'
18"
20
22
24
30
32
34
36
38
40
42
44
48
50
52
54
56

EQUIPMENT FOR USE WHEN SITTING AND WHEN WALKING, SKIING OR THE LIKE

BACKGROUND

Field of the Invention

This invention relates to equipment for use when walking, skiing or the like and also for use when sitting.

Background of the Related Art

When out in the countryside, many people like to take a stick, or a pair of sticks, with them. They can then use the stick, for example, to steady themselves when walking and to push back brambles and nettles blocking their way. When out in the countryside, many people also like to sit down occasionally for a rest or while they take in a view.

A device called a "shooting stick" is known. A shooting stick comprises a stick member with a pair of seat members pivotally mounted at one end of the stick member. With the seat members in a closed-together position, they act as a handle and the shooting stick can be used as a walking stick, whereas with the seat members in an opened-out position, they form a seat so that the shooting stick can be used as a single-legged stool.

A problem with using a shooting stick as a stool is that, because it is single-legged, it can lead to instability. In order to sit stably on a shooting stick, a person needs to keep both feet on the ground, with their feet and the bottom end of the shooting stick arranged at the corners of a triangle.

SUMMARY OF THE INVENTION

An aim of the present invention, or at least of specific embodiments of it, is to overcome this problem.

The invention is also applicable to other forms of stick, such as ski-sticks. Therefore, in this specification, the term "walking stick" is intended to encompass not only walking sticks but also hiking sticks, canes, ski-sticks, alpenstocks, shillelaghs and the like Simply stated, the invention provides equipment that can be used as a pair of walking sticks but can also be configured as a two-legged stool.

Alternatively stated, the invention provides equipment comprising a pair of walking sticks, with each walking stick comprising an elongate stick member having a bottom end for placing on the ground and a top end, and a seat member disposed adjacent the top end of the stick member. The equipment further includes means for releasably attaching the walking sticks together adjacent the top ends of the stick members so that the seat members together form a seat and so that the stick members diverge from the seat so that the equipment can be used as a two-legged stool.

A person can sit on the stool with their feet and the two legs of the stool arranged at the corners of a rectangle, and the arrangement will be stable. If the person moves their feet together, so that their feet and the two legs of the stool are arranged at the corners of a triangle, or if the person lifts one of their feet off the ground, the arrangement will remain stable.

The means for releasably attaching the walking sticks together is preferably arranged to attach the seat members directly to each other and may be arranged for releasably locking the seat members to each other.

Each seat member is preferably pivotally mounted to the top end of the respective stick member for movement between: a first position in which the seat member extends at an acute angle from the top end of the respective stick member; and a second position in which the seat member extends alongside the respective stick member adjacent its top end. Each seat member is preferably prevented from pivoting beyond its first position relative to the respective stick member. Therefore, when used as a stool, if the stick members are spread apart as far as possible and their bottom ends are placed on the ground, the angles of the stick members to the seat will effectively become locked. Nevertheless, means may also be provided for releasably locking each seat member in its first position and/or in its second position relative to the respective stick member.

Each stick member is preferably telescopically adjustable in length to suit the user when walking and also to enable the height of the two-legged stool to be adjusted.

DRAWINGS

A specific embodiment of the invention will now be described, purely by way of example, with reference to the accompanying drawings in which.

DETAILED DESCRIPTION

Figures 1, 2, 3, 4:
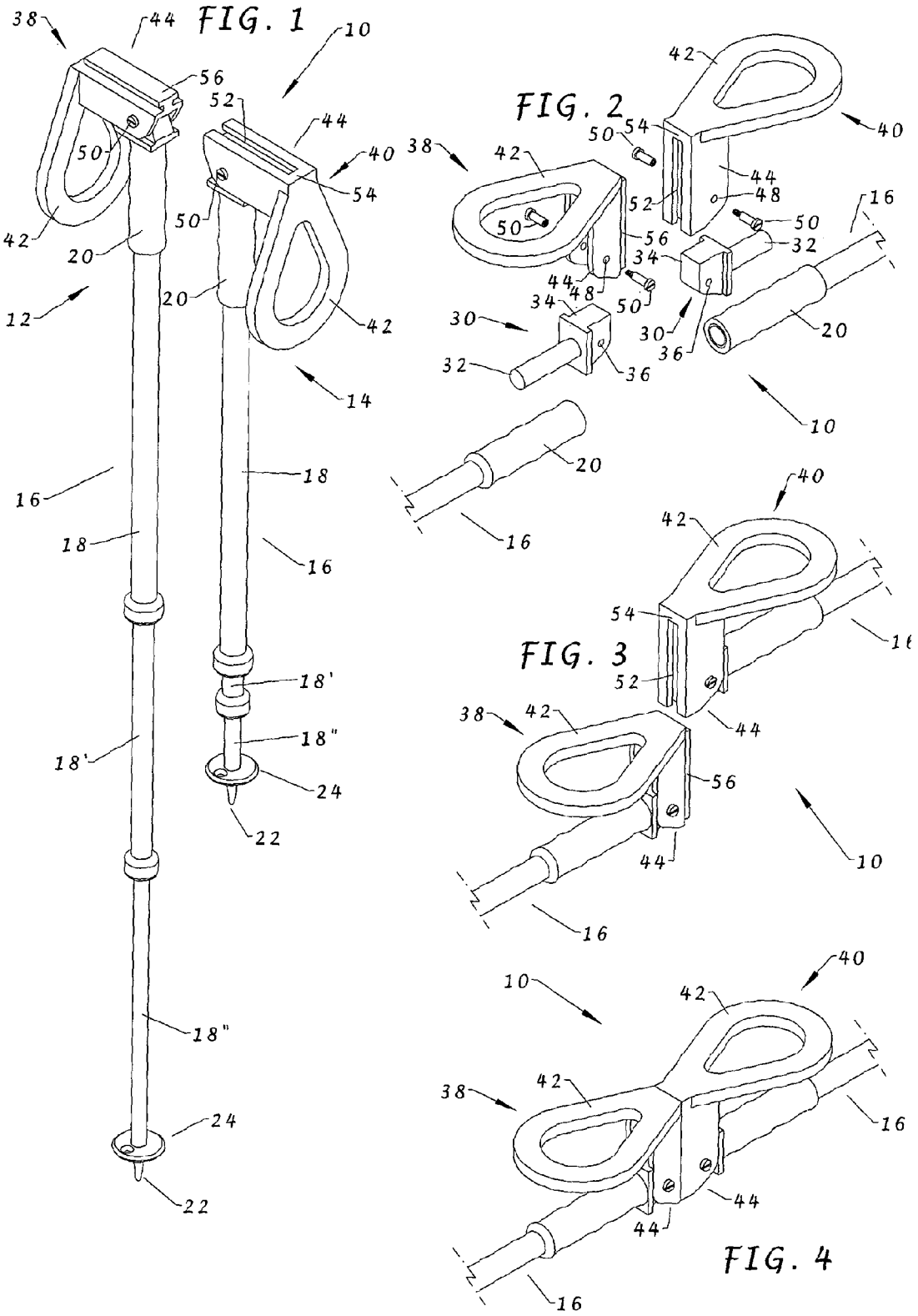
FIG. 1 is an isometric view of a pair of walking sticks.
FIG. 2 is an exploded isometric view of the pair of walking sticks (but showing only part of each stick portion)
FIG. 3 is similar to FIG. 2, but with each walking stick assembled and with the walking sticks detached from each other.
FIG. 4 is similar to FIG. 3, but with the walking sticks attached to each other.

Referring to FIGS. 1 to 6 of the drawings, equipment 10 embodying the invention comprises a pair of walking sticks 12, 14. Each walking stick 12,14 includes a stick member 16 having a number of telescopically adjustable and lockable tubes 18, 18', 18" with a hand grip 20 at the top end and a point 22, ferrule, pad and/or depth limiter 24 at the bottom end. Each stick member 16 may be of conventional design, except that, as shown in FIG. 2, the hand grip 20 does not close off the hole at the top of the top tube 18.

Each walking stick 12,14 also includes a connector 30 having a cylindrical peg 32 which is inserted into the top end of the respective stick member 16 and fixed therein, for example by adhesive, crimping, a rivet or a screw. Each connector 30 also has a pivot block 34 having a pivot hole 36 and a particularly shaped surface that will be described below.

Each walking stick 12,14 furthermore includes a seat member 38,40 having a seat portion 42 and a bracket 44. The bracket portion 44 is in the form of a channel having a pair of side walls which fit to either side of the pivot block 34 of the respective connector 30. The channel side walls are formed with holes 48 for alignment with the pivot hole 36 in the pivot block 34. A pair of complementary screw fasteners 50 pass through the holes 36,48 to attach each seat member 38,40 to its stick member 16. The seat portions 42 are shown in the drawings as each having the form of a tear-drop shaped loop extending away from the bracket portion 44, but they may have other shapes.

The connectors 30 and seat members 38,40 may be made of any suitable material by any suitable method, such as injection-moulded plastics material, or die-cast alloy.

Figure 5:
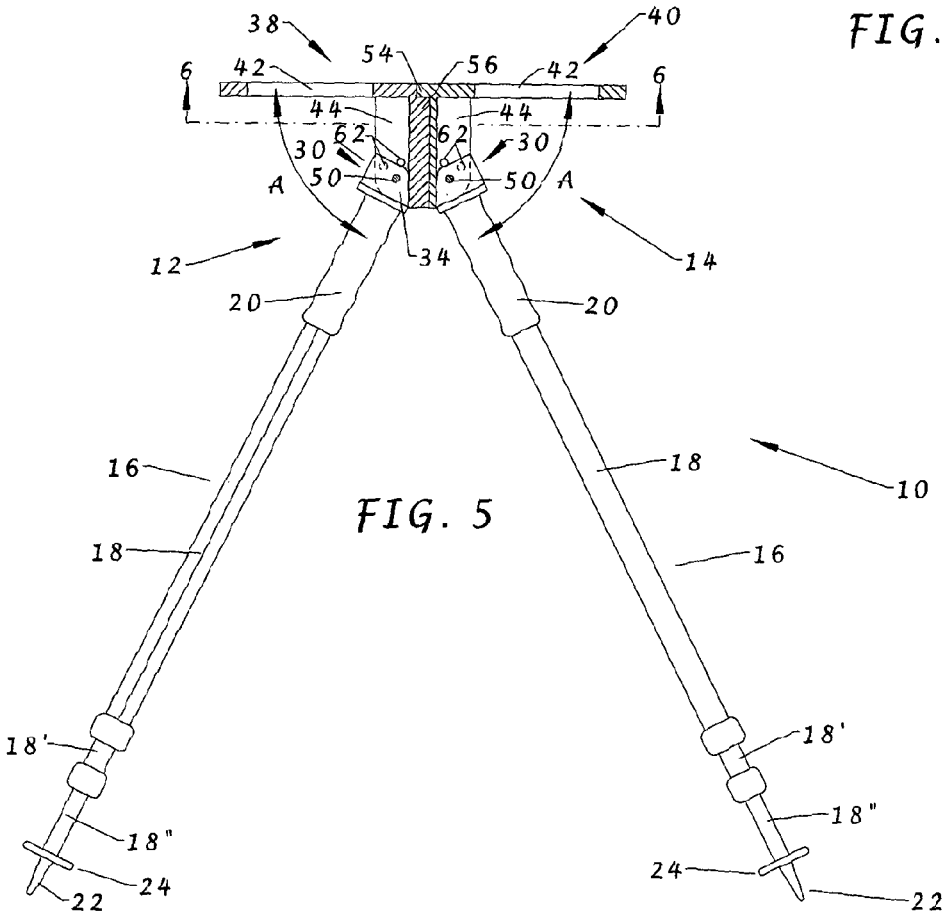
FIG. 5 is a sectioned front view of the pair of walking sticks attached to each other and configured as a two-legged stool.

The pivot blocks 34 and brackets portions 44 are shaped so that each seat member 38,40 can be pivoted with respect to its stick member 16 between (1) a first limiting position as shown in FIGS. 1, 3 and 4 in which the bracket portion 44 extends approximately at right angles to the top end of the stick member 16, and the seat portion 42 extends alongside and approximately parallel to the hand grip 20 of the stick member with a spacing such that a user can place their hand between the seat portion 42 and hand grip 20 and grasp the hand grip 20, and (2) a second limiting position as shown in FIG. 5 in which the seat member 38,40 has been pivoted through an angle of between about 50° and 75° relative to its stick member 16 so that there is an acute angle A between each seat member 38,40 and its stick member 16.

Figure 6:
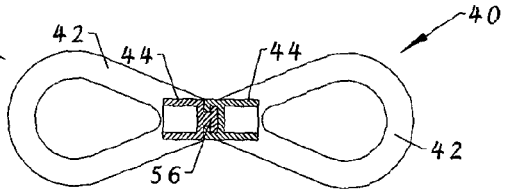
FIG. 6 is an underplan view taken on the section line 6-6 shown in FIG. 5.

The bracket portion 44 of one of the seat members 40 is formed with a T-shaped slot 52 facing in the opposite direction to the direction in which the seat portion 42 extends away from the bracket. portion The slot 52 extends along most of the length of the bracket portion 44, but is blocked by a stop 54 at its upper end as viewed in FIGS. 2 and 3. The bracket portion 44 of the other seat member 38 is formed with a complementary T-shaped key 56. The two seat members 40 can therefore be aligned as shown in FIG. 3, and the T-shaped key 56 can be slid into the T-shaped slot 52 up to the stop 54 so that the two seat members 38,40 become aligned and held together, as shown in FIGS. 4 to 6, so as to form a seat.

Figure 7:
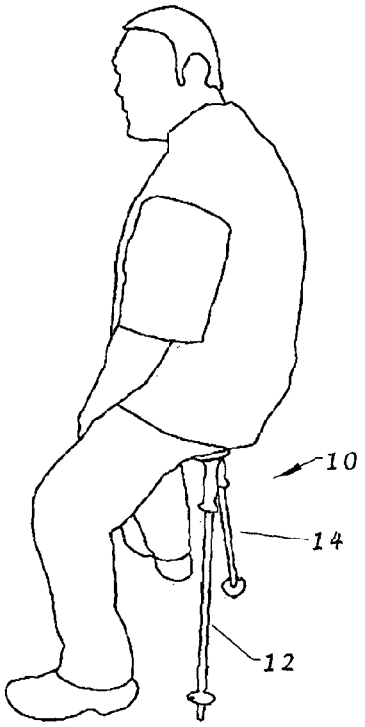
FIG. 7 is a view of a person sitting on the stool.

The equipment 10 can therefore be used as a pair of walking sticks, as shown in FIG. 1, with the seat members 38,40 in their first positions, and with the stick members 16 adjusted to provide a desired stick length. The equipment 10 can also be reconfigured by attaching the seat members 38,40 together as described above and by pivoting the stick members 16 to their second positions, so as to form a two-legged stool as shown in FIGS. 5 and 7, with the stick members 16 adjusted to provide a desired stool height.

Figure 8:
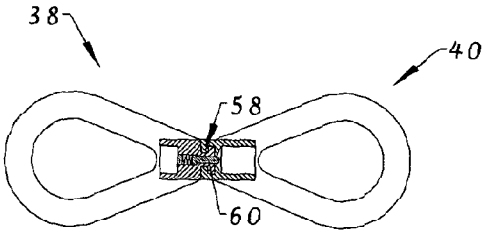
FIG. 8 is similar to FIG. 6, but showing a modification.

Although the equipment 10 described above does not itself include any means for locking the seat members 38,40 together to prevent them sliding apart, or to lock the stick members 16 in their second positions, when the equipment 10 is being used as a stool, it has been found that such locking means are not necessary. Nevertheless, as shown in FIG. 8, a releasable latch 58 may be provided for locking the seat members 38,40 together. As shown, the latch 58 may comprise a spring-loaded pin 60 which is held captive in the bracket portion 44 of the seat member 38 and has a projecting rounded end which can engage in a hole in the bracket portion 44 of the other seat member 40. A recess is provided around the hole, so that a user can depress the pin 60 to release the latch 58. Similarly, latches can be provided between the bracket portions 44 of the seat members 38,40 and the pivot blocks 34 of the connectors 30 for releasably locking the stick members 16 in their first positions and/or their second positions. These latches may, for example, employ spring-loaded pins which can engage in holes 62, as shown in FIG. 5, in the side walls of the channels of the bracket portions 44.

Although it is preferable that the seat members 38,40 are pivotable, the equipment 10 described above may be modified so that the seat members 38,40 are in fixed positions relative to the stick members 16.

The equipment 10 described above does provide the user with two walking sticks 12,14. For people who prefer to walk using just one stick, one or each of the sticks may be provided with a sling so that it can be carried on the user's shoulder.

The embodiment of the invention has been described above by way of example only, and many other modifications and developments may be made thereto within the scope of the present invention.

The invention claimed is:

1. A seat for use with a pair of walking sticks, comprising two seat members, each of the two seat members including means for releasably attaching to the other of the two seat members, and a pivot block which is adapted to attach to a respective hand grip of the respective one of the pair of walking sticks, the hand grip fitting over an end of the respective walking stick and being pivotally connected to the respective one of the two seat members by way of a bracket portion, wherein each of the two seat members are pivotable with respect to its associated walking stick between a deployed position wherein the bracket portion extends substantially at a right angle with respect to a top of the respective walking stick; and a stowed position in which each of the two seat members extend alongside and approximately parallel with the hand grip of the respective walking stick with a spacing such that a user is able to place their hand between the respective seat member and the hand grip, and wherein in the deployed position inter-engagement of the two seat members together form a seat and the pair of walking sticks diverge from the seat in order to form a two-legged stool.

2. The seat for use with a pair of walking sticks as claimed in claim 1, wherein:

said means for releasably attaching is arranged to attach the two seat members directly to each other.

3. The seat for use with a pair of walking sticks as claimed in claim 1, wherein:

each of the two seat members is prevented from pivoting beyond its deployed position relative to the respective walking stick.

4. The seat for use with a pair of walking sticks as claimed in claim 1, further including:

means for releasably locking each of the two seat members in its deployed position relative to the respective walking stick.

5. The seat for use with a pair of walking sticks as claimed in claim 1, further including:

means for releasably for locking each of the two seat members in its stowed position relative to the respective walking stick.

6. The seat for use with a pair of walking sticks as claimed in claim 1, wherein:

each of the pair of walking sticks is telescopically adjustable in length.

* * * * *